US006308387B1

(12) United States Patent
Borzi

(10) Patent No.: US 6,308,387 B1
(45) Date of Patent: Oct. 30, 2001

(54) ANTI-FRICTION DEVICE FOR THE SLIDING OF CLOTH RINGS OF CURTAINS, PELMETS AND SIMILAR

(76) Inventor: Enzo Borzi, via dei Conti di Tuscolo 5, 00175 Roma (IT)

( * ) Notice: Subject to any disclaimer, the term of this patent is extended or adjusted under 35 U.S.C. 154(b) by 0 days.

(21) Appl. No.: 09/423,832

(22) PCT Filed: Nov. 24, 1998

(86) PCT No.: PCT/IT98/00338

§ 371 Date: Nov. 16, 1999

§ 102(e) Date: Nov. 16, 1999

(87) PCT Pub. No.: WO99/47031

PCT Pub. Date: Sep. 23, 1999

(30) Foreign Application Priority Data

Mar. 18, 1998 (IT) ..... RM980080 U

(51) Int. Cl.[7] ..... A44B 18/00; A47H 13/00

(52) U.S. Cl. ..... 24/716; 24/306; 24/706.1; 16/87.2

(58) Field of Search ..... 24/306, 716, 706.1, 24/600.9, 304; 16/87.2

(56) References Cited

U.S. PATENT DOCUMENTS

| | | | | |
|---|---|---|---|---|
| 380,932 | * | 4/1888 | Rings | 16/87.2 |
| 1,493,057 | * | 5/1924 | Van Patten | 16/87.2 |
| 2,417,623 | * | 3/1947 | Yellin | 16/87.2 |
| 2,556,461 | * | 6/1951 | Baron | 24/716 |
| 2,652,586 | * | 9/1953 | Ramsberger | 16/87.2 |
| 3,315,297 | | 4/1967 | Bender . | |
| 3,387,341 | * | 6/1968 | Mates et al. | 24/306 |
| 5,345,989 | * | 9/1994 | Brophy | 160/354 |
| 5,632,071 | | 5/1997 | Maunder . | |
| 5,894,642 | * | 4/1999 | Eberhardt | 24/716 |

FOREIGN PATENT DOCUMENTS

| | | |
|---|---|---|
| 295 20 692 U | 2/1996 | (DE) . |
| 48 921 | 12/1966 | (LU) . |

* cited by examiner

*Primary Examiner*—Victor N. Sakran
(74) *Attorney, Agent, or Firm*—Smith, Gambrell & Russell, LLP

(57) ABSTRACT

An anti-friction device for the sliding of cloth rings of curtains, pelmets and similar which includes a shaped element out of wood, metal, plastic or other material, corresponding to the curving of the lateral surface of a support. The anti-friction device is provided with an applicator such as a hook and loop fastener combination for the application of the shaped element into the internal upper portion of each cloth ring, so as to be arranged between the ring and the support, thus helping the reciprocal sliding.

6 Claims, 2 Drawing Sheets

ANTI-FRICTION DEVICE FOR THE SLIDING OF CLOTH RINGS OF CURTAINS, PELMETS AND SIMILAR

The present invention concerns an anti-friction device for the sliding of cloth rings of curtains, pelmets and similar.

It is known that at present users like to replace the conventional wood, metal or plastic sliding rings on the support for curtains, pelmets and similar with corresponding rings produced with the same cloth and/or color shade of the curtains.

This solution shows the disadvantage that the deformability of said rings and their considerable friction along the supports don't allow an easy sliding of the curtains.

It is the aim of the present invention to completely solve above mentioned inconvenience by means of a device which maintains the possibility of using aesthetically pleasant cloth rings and allows an easy sliding thereof along the support, as if they were of wood, metal or plastic, greatly reducing the friction.

The aim set forth is reached by means of the device according to the present invention, consisting of an element out of rigid plastic material or other kind, having a curving corresponding to the one of the lateral surface of the support, and provided with means for being applied in the internal upper portion of each cloth ring, so as to be arranged between the ring and the support, helping the reciprocal sliding and transforming the friction into a rolling friction similar to the one of the conventional wood, plastic or metal rings. Furthermore, the device has minimal dimensions so that it may be housed inside the cloth eyelets of already existing curtains, into which no structure of long shape could be inserted.

The device according to the present invention will be described more in detail hereinbelow relating to the enclosed drawings, in which.

The enclosed figures show an anti-friction device for the sliding of cloth rings of curtains, pelmets and similar, mainly consisting of:

a rigid shaped element 1, out of wood, plastic or metal or other material, having a lower curving corresponding to the one of the lateral surface of the support B for the sliding of pelmets M, so as to be arranged between said support B and the upper internal surface SSI of each cloth ring A, usually produced with the same material and color shade of the curtain M, so as to form an aesthetic continuity;

a means for applying said element 1 to each ring A, consisting of a portion 2 of velcro or similar, integral with said element 1, and with a corresponding connection element 3 that may be applied to the surface SSI of each ring A, so as to allow the same to slide along the support B without a particular friction, as it will result integral with said shaped element 1.

Figure 1:
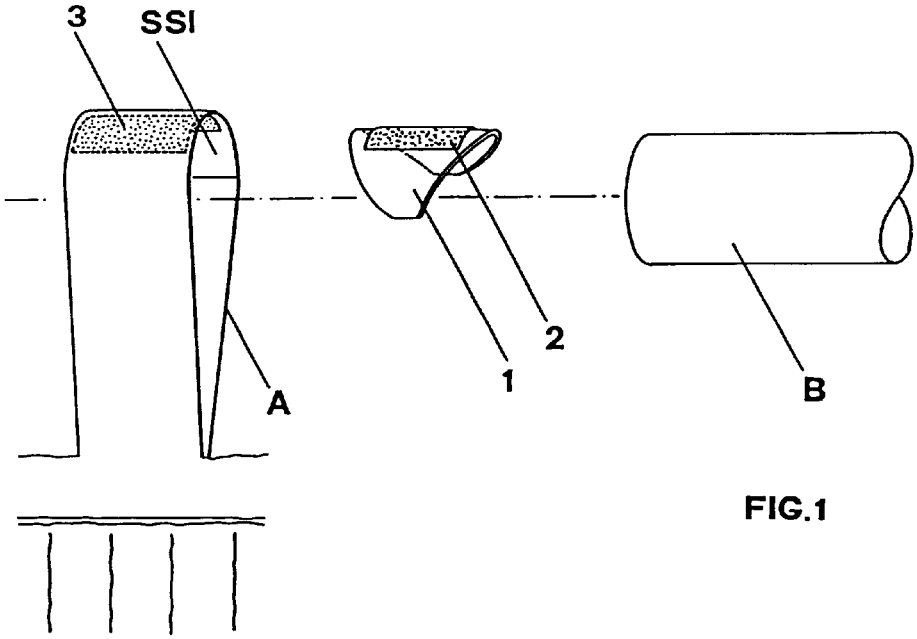
FIG. 1, shows an axonometric exploded view of an anti-friction device for the sliding of cloth rings of curtains, pelmets and similar, according to the present invention.
Figure 2:
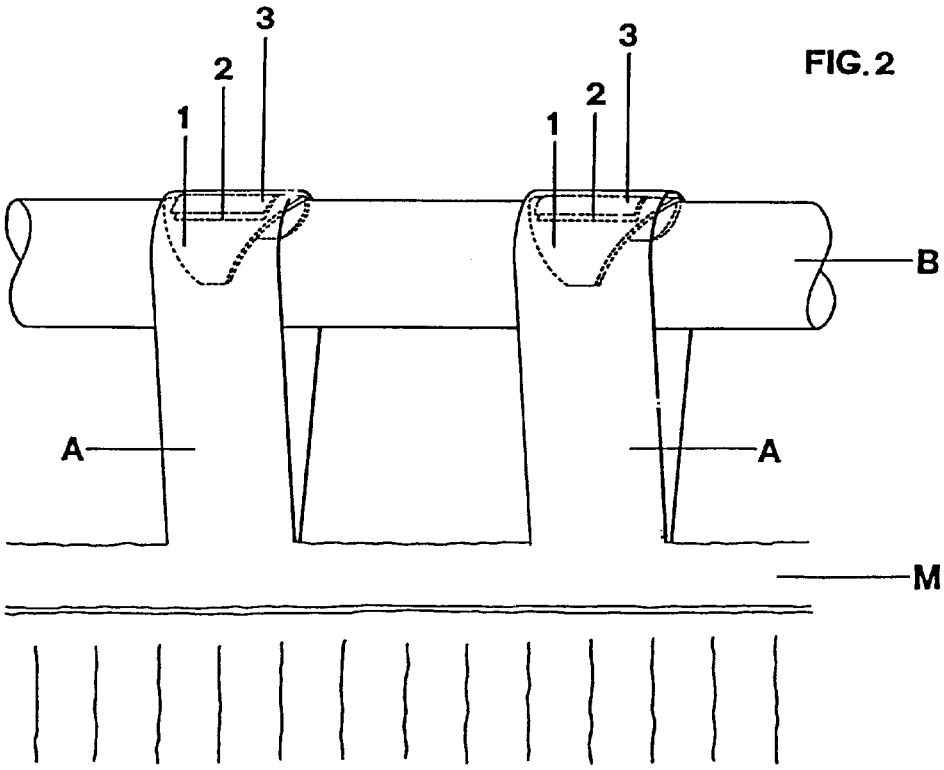
FIG. 2, shows an axonometric and partially transparency view of some embodiments according to FIG. 1, installed for the sliding of a pelmet M.
Figure 3:
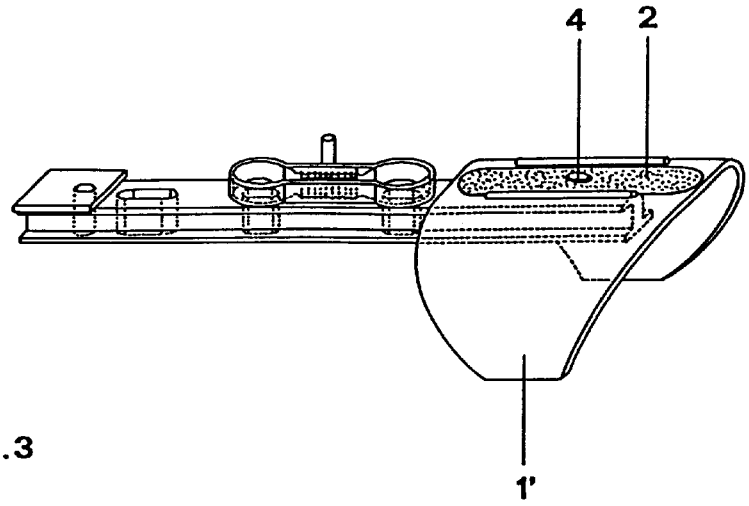
FIG. 3, shows an axonometric view of the arrangement of the end elemet 1' for the control of the pulling of the cord for the sliding of the curtain.
Figure 4:
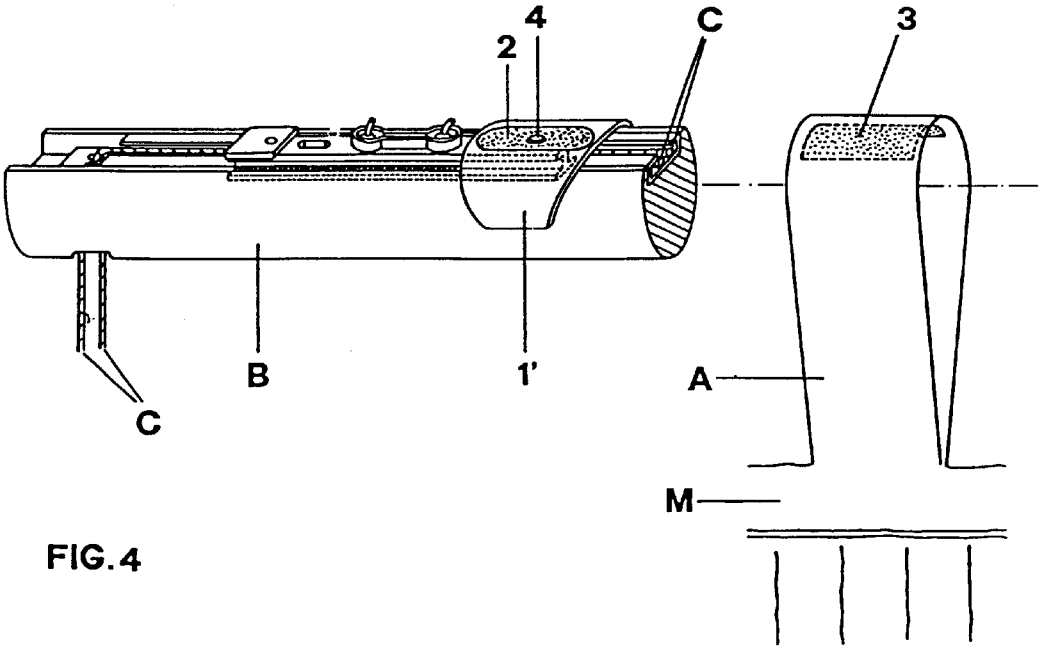
FIG. 4 shows the installation of element 1' of FIG. 3 onto a cloth ring A.

According to the present invention, the modular elements 1 must be of very small dimensions so as to be housed inside said cloth rings A of already existing curtains, and must be realized out of rigid material for forming a resistant support when the end element 1' (as shown in FIGS. 3 and 4) must be connected in point 4 to the cord C for traction, for closing and opening the curtain M.

What is claimed is:

1. An anti-friction device for the sliding of cloth rings of curtains, pelmets and similar along a support comprising:

a rigid shaped element having a lower curving corresponding to a lateral surface of the support, for the sliding of curtains, pelmets, or similar, so as to be arranged between the support and an upper internal surface of each cloth ring; and a means for applying said element to each ring wherein said means is applied to the surface of each ring, so as to allow each ring to slide along the support with reduced friction.

2. An anti-friction device according to claim 1, wherein the device is rigid so as to form a resistant support and an end of said device is connected to a cord which opens and closes said curtain, pelmets, or similar.

3. An anti-friction device according to claim 1, wherein the rigid shaped element is comprised of material selected from the group consisting of wood, plastic and metal.

4. An anti-friction device according to claim 1, wherein said means for applying said element to each ring includes means for releasably attaching said element to each ring.

5. An anti-friction device according to claim 4, wherein said means for releasably attaching said element to each ring includes a hook and loop fastener combination.

6. A curtain or pelmet assembly, comprising: a curtain or pelmet having cloth rings; and the anti-friction device of claim 1 applied to each of said cloth rings.

* * * * *